United States Patent [19]

Yamamoto

[11] Patent Number: 4,603,990

[45] Date of Patent: Aug. 5, 1986

[54] MECHANICAL PENCIL WITH REFILL CARTRIDGE

[75] Inventor: Ken Yamamoto, Kawagoe, Japan

[73] Assignee: Kotobuki & Co., Ltd., Kyoto, Japan

[21] Appl. No.: 512,538

[22] Filed: Jul. 11, 1983

[30] Foreign Application Priority Data

Oct. 15, 1982 [JP] Japan ..... 57-156911[U]

[51] Int. Cl.[4] ..... B43K 21/00; B43K 21/20

[52] U.S. Cl. ..... 401/85; 401/65; 401/89; 401/57

[58] Field of Search ..... 401/89, 90, 85, 57, 401/65, 67, 86, 82, 78

[56] References Cited

U.S. PATENT DOCUMENTS

| | | | |
|---|---|---|---|
| 1,531,427 | 3/1925 | Vierling | 401/82 |
| 1,698,353 | 1/1929 | Vierling | 401/82 |
| 2,240,604 | 5/1941 | Berger | 120/42 |
| 2,287,894 | 6/1942 | Lynn | 401/86 X |
| 2,533,513 | 12/1950 | Savoie | 401/78 |
| 2,626,592 | 1/1953 | Hedler | 401/67 |
| 4,240,759 | 12/1980 | Matsumoto et al. | 401/85 |
| 4,247,215 | 1/1981 | Leuthold et al. | 401/85 |

FOREIGN PATENT DOCUMENTS

| | | | |
|---|---|---|---|
| 107272 | 5/1984 | European Pat. Off. | 401/85 |
| 804293 | 7/1949 | Fed. Rep. of Germany . | |
| 812891 | 9/1951 | Fed. Rep. of Germany | 401/65 |
| 386402 | 6/1908 | France . | |
| 2391860 | 12/1978 | France . | |
| 2493769 | 5/1982 | France . | |
| 54-51052 | 4/1979 | Japan | 401/89 |
| 8300309 | 2/1983 | World Int. Prop. O. | 401/89 |
| 684173 | 12/1952 | United Kingdom | 401/85 |

*Primary Examiner*—Steven A. Bratlie

*Attorney, Agent, or Firm*—Lee C. Robinson, Jr.

[57] ABSTRACT

A mechanical pencil comprising a lead feed mechanism built within the body thereof and a lead guide connected to the lead feed mechanism and having a cartridge reception bore of a diameter which is practically the same as the inside diameter of the body, wherein a cartridge containing a plurality of leads and having an outside diameter which is practically the same as the inside diameter of the body and the inside diameter of the cartridge reception bore of the lead guide is detachably fitted in the cartridge reception bore of the lead guide. In replenishing the mechanical pencil with leads, an old cartridge is replaced with a new cartridge.

5 Claims, 4 Drawing Figures

MECHANICAL PENCIL WITH REFILL CARTRIDGE

BACKGROUND OF THE INVENTION

1. Field of the Invention

The present invention relates to a mechanical pencil and more particularly to a cartridge of lead for mechanical pencils, which cartridge is capable of functioning as a lead-holding pipe.

2. Description of the Prior Art

In replenishing a conventional mechanical pencil with leads after the leads of the mechanical pencil have been exhausted, leads have to be taken out from a case of lead and supplied into the lead-holding pipe of the mechanical pencil one by one. Such a replenishing work is troublesome, and besides, the leads soil the hand during the replenishing work.

SUMMARY OF THE INVENTION

Accordingly, it is an object of the present invention to provide a mechanical pencil capable of allowing the replacement of an exhausted cartridge with a cartridge containing leads, and thereby obviating the necessity of supplying leads one by one and the hand being soiled, and capable of allowing the simple replacement of the cartridge even when there are residual leads in the mechanical pencil.

BRIEF DESCRIPTION OF THE DRAWINGS

The present invention will be more apparent from the ensuing description of the preferred embodiment thereof, with reference being made to the accompanying drawings, wherein.

DESCRIPTION OF THE PREFERRED EMBODIMENTS

Figure 1:
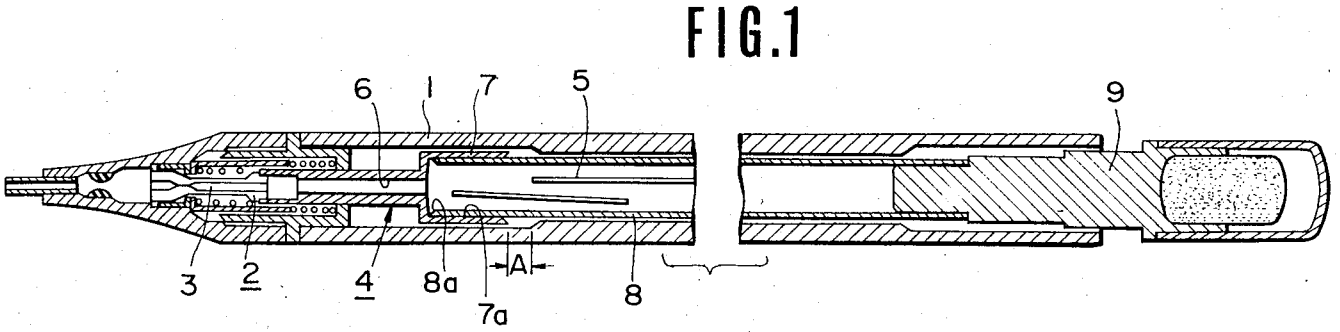
FIG. 1 is a longitudinal sectional view of a preferred embodiment of a mechanical pencil according to the present invention.
Figure 4:
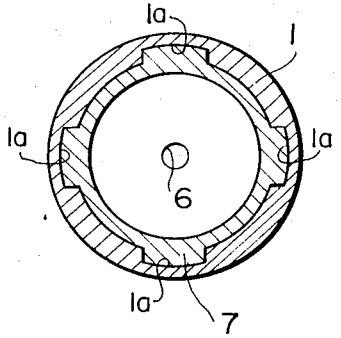
FIG. 4 is an enlarged transverse cross-sectional view of a portion of the mechanical pencil of a modified embodiment of this invention illustrating the fit between the lead guide and the body of the mechanical pencil.
Figure 2:
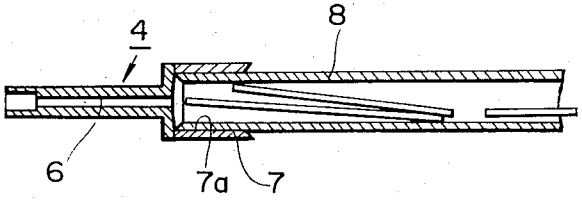
FIGS. 2 and 3 are longitudinal sectional views of a modified form of the lead guide of a mechanical pencil according to the present invention.
Figure 3:
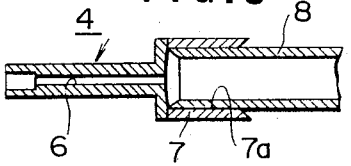

Referring to FIG. 1, a lead guide 4 is fitted in an outer pipe 1 behind the lead chuck 3 of a lead feed mechanism 2 built within the outer pipe 1. The lead guide 4 is adapted to feed leads one by one to the lead chuck 3. The lead guide 4 is provided internally with a lead feed bore 6 of a size which permits the passage of a single lead 5 at a time therethrough, and a cartridge reception bore 7*a* of a diameter which is practically the same as the inside diameter of the outer pipe 1 and the outside diameter of a cartridge 8 to be fitted therein. The bore 7*a* is formed in the off-set part 7 of the guide 4. The part having the lead feed bore 6 and the off-set part 7 of the lead guide 4 may be formed individually as shown in FIGS. 2 and 3. As shown in FIG. 4, grooves 1*a* may be formed in the inside surface of the outer pipe 1 in order to locate the lead guide 4 properly within the outer pipe 1. An interval A provided behind the lead guide 4 (FIG. 1) is a cushioning clearance.

The cartridge 8 is detachably fitted in the cartridge reception bore 7*a* of the lead guide 4. A cap 9 is fitted detachably in the rear end of the cartridge 8. A plurality of leads 5 are contained in the cartridge 8. Usually, the cartridge 8 containing leads 5 is available in shops. The outside diameter of the cartridge 8 is practically the same as the inside diameter of the cartridge reception bore 7*a* and the inside diameter of the outer pipe 1. Preferably, a lead guiding taper 8*a* is formed in the inner extremity of the cartridge 8. The cartridge 8 and the off-set part 7 may be joined by force fit as in this embodiment, or by means of slits formed in the off-set part 7, projections or joining members. The cartridge 8 and the lead guide 4 are designed so that the connection between the cartridge 8 and the cap 9 fitted in the rear end of the cartridge 8 is more secure than the connection between the cartridge 8 and the lead guide 4. With this arrangement the cartridge 8 is separated from the lead guide 4 when the cap 9 is pulled, while the cartridge and the cap remain together as a unit.

When the cartridge 8 is exhausted during writing, the cap 9 is pulled to separate the exhausted cartridge 8 from the lead guide 4 and to remove the same. Then, a new cartridge 8 containing a plurality of leads 5 is inserted into the mechanical pencil and pushed into the lead guide 4, so that the cartridge 8 is connected automatically to the lead guide 4. Since the outside diameter of the cartridge 8 is practically the same as the inside diameter of the outer pipe 1 and the inside diameter of the cartridge reception bore 7*a* of the lead guide 4, the new cartridge 8 smoothly receives the leads 5 remaining within the pipe 1 without breaking those residual leads 5 and without being obstructed by those residual leads 5. When the taper 8*a* is formed in the extremity of the cartridge 8, in particular, the taper 8*a* guides the residual leads 5 surely and safely into the new cartridge 8 even if those residual leads 5 are tilted. Furthermore, since the cartridge 8 serves as a lead container as well as a lead pipe when fitted in the lead guide 4, the construction of the mechanical pencil is simplified.

As described hereinbefore, according to the present invention, the mechanical pencil is replenished with leads through simple replacement of an exhausted cartridge with a new cartridge containing a plurality of leads. Accordingly, it is not necessary to supply leads one by one as in the conventional mechanical pencil and hence the hand will not be soiled. Furthermore, according to the present invention, the leads remaining within the outer pipe in changing the cartridge can be guided into the new cartridge without being broken and without interfering with the insertion of the new cartridge. Still further, the present invention simplifies the construction of the mechanical pencil and facilitates the replenishment of the mechanical pencil with leads.

What is claimed is:

1. A mechanical pencil having an outer pipe with forward and rearward portions, said outer pipe having a bore formed with a first inside height and diameter and a bore formed with a second inside diameter, said second inside diameter being constricted to a diameter smaller than said first inside diameter to facilitate ease of loading of replacement cartridges, the pencil comprising a lead feed mechanism fitted in the outer pipe, a lead guide connected to the lead feed mechanism and having an abbreviated cylindrical cartridge reception bore of a height and diameter which is practically the same as the bore formed with the first inside diameter of the outer pipe and having a beveled receiving lip, and a cylindrical cartridge slidably mounted from the rearward portion of the outer pipe and adapted to be detachably fitted in a telescoping relationship within the cartridge reception bore of the lead guide to present a continuous supply of leads to said lead guide and having a friction fit with the rearward portion of the outer pipe to maintain the cartridge securely and operably within the pencil, said cartridge having an outside diameter which is practically the same as the second inside diameter of the outer pipe and the inside diameter of the cartridge reception bore to provide a close fit between the cartridge and the outer pipe and being axially detachable from said outer pipe by moving the same in an axial direction with respect thereto.

2. A mechanical pencil having an outer pipe with forward and rearward portions, said outer pipe having a first inside diameter and a second inside diameter, said second inside diameter being constricted to a diameter smaller than said first inside diameter, the pencil comprising:

(a) a lead feed mechanism fitted in the outer pipe;

(b) a lead guide connected to said lead feed mechanism and having an abbreviated cylindrical cartridge reception bore of a height and diameter which is substantially equal to the bore formed with the first inside diameter of said outer pipe and having a beveled receiving lip;

(c) a cylindrical cartridge slidably mounted from the rearward portion of the outer pipe and adapted to be detachably fitted in loose telescoping relationship within said abbreviated cartridge reception bore of said lead guide to present a continuous supply of leads to said lead guide, said cartridge having a friction fit with the rearward portion of the outer pipe to maintain the cartridge securely and operably within the pencil and being detachable from said outer pipe by moving the same solely in an axial direction with respect thereto, the cartridge having an outside diameter which is substantially equal to the second inside diameter of said outer pipe and the inside diameter of said cartridge reception bore to provide a close fit between the cartridge and the outer pipe, said constriction and close fit facilitating ease of loading of replacement cartridges, and (d) means cooperating with the cylindrical cartridge and including a tapered surface disposed in position to guide residual leads within said pipe into said cartridge.

3. A mechanical pencil according to claim 2, which further comprises a cap fitted to one end of the cylindrical cartridge, the fit between said cap and sais one end being more secure than the fit between the cartridge and the cartridge reception bore.

4. A mechanical pencil according to claim 2, in which said tapered surface is disposed on the portion of said cartridge within said cartridge reception bore.

5. A mechanical pencil according to claim 2, in which said surface tapers inwardly from the outer periphery of the cylindrical cartridge in a direction away from the lead feed mechanism.

* * * * *